United States Patent [19]

Hansen et al.

[11] Patent Number: 4,551,900

[45] Date of Patent: Nov. 12, 1985

[54] METHOD OF AND APPARATUS FOR MOUNTING SEPARABLE SLIDE FASTENER CONNECTORS

[75] Inventors: Henning Hansen, Aichtal; Helmut Schneider, Stuttgart, both of Fed. Rep. of Germany

[73] Assignee: Dr. Karl F. Nagele Feinmaschinenbau GmbH & Co, Filderstadt, Fed. Rep. of Germany

[21] Appl. No.: 642,273

[22] Filed: Aug. 20, 1984

[30] Foreign Application Priority Data

Jan. 28, 1984 [DE] Fed. Rep. of Germany ..... 3402908

[51] Int. Cl.[4] ..... B21D 53/50; A41H 37/06

[52] U.S. Cl. ..... 29/408; 29/767; 29/33.2

[58] Field of Search ..... 29/33.2, 408, 766, 767

[56] References Cited

U.S. PATENT DOCUMENTS

| | | | |
|---|---|---|---|
| 2,702,064 | 2/1955 | Lange | 29/767 |
| 3,488,239 | 1/1970 | Heimberger | 29/408 |
| 3,698,064 | 10/1972 | Uhrig | 29/408 |
| 3,714,698 | 2/1973 | Fukori | 29/408 |
| 4,309,233 | 1/1982 | Akashi | 29/408 |
| 4,494,293 | 1/1985 | Kawakami | 29/408 |
| 4,495,695 | 1/1985 | Umino | 29/408 |

*Primary Examiner*—Howard N. Goldberg
*Assistant Examiner*—Steven Nichols
*Attorney, Agent, or Firm*—Karl F. Ross; Herbert Dubno

[57] ABSTRACT

Pin and box elements for the separable connection of the ends of the respective halves of a slide fastener are applied by deflecting the coupled stringer previously provided with the slider, at an angle to enable the elements to be threaded through the window onto respective edges in the shadow of the deflected stretch of the band.

13 Claims, 14 Drawing Figures

METHOD OF AND APPARATUS FOR MOUNTING SEPARABLE SLIDE FASTENER CONNECTORS

FIELD OF THE INVENTION

Our present invention relates to a method of and to an apparatus for the mounting of the connectors of a separable slide fastener from the stringer before separation of the latter from a continuous stringer strip, the connectors including the box element which is affixed to one stringer half and the pin element which is affixed to the other stringer half.

BACKGROUND OF THE INVENTION

A slide fastener stringer generally comprises a pair of coupling elements mounted upon respective stringer tapes and formed with interdigitatable coupling heads of a given spacing or pitch so that when a slider is moved along the stringer, the coupling elements are interconnected and when the slider is moved along the stringer in the opposite direction, the coupling elements are separated from one another.

The coupling elements can be continuous elements in the form of a coil or meander of a synthetic resin monofilament or can be rows of individual coupling heads which are mounted on the edge of the support tape, e.g. by clamping the individual coupling head onto the edge.

Other methods of affixing the coupling elements (this term being synonymous with the row of coupling heads) to the tape include fitting the coupling heads through openings in the tape, weaving or knitting the tape around the coupling elements, or stitching the coupling elements to the tape.

For separable slide fasteners, at one end of the stringer consisting of the two stringer halves, the slider and any end stop members which may be required, a plug and socket connection can be provided.

This plug and socket assembly can include a male member or pin element which can be inserted through the slider and into the female member or box element of the other stringer half to thereby position the two stringer halves at the end at which the slider is disposed to enable the slider to merge the coupling heads and secure the stringer halves together.

The stringer is generally produced in the form of a continuous tape or strip and can be formed with a T-shaped opening at the region at which the connecting elements are to be applied for facilitating the assembly of the slider onto the coupling elements as well as the mounting of the pin and box-connecting elements thereon. It will be appreciated that the region of this T-shaped cutout can be reinforced, e.g. by coating, cementing or otherwise applying reinforcing foil elements to the edges of the opening before or after the formation of the cutout. The connecting elements can be of the split-sleeve type which can be threaded onto the respective edges of the respective stringer halves and clamped thereon to close the slit around the fabric of the respective support tape.

In German patent document Open Application DE-OS No. 21 12 076, the corresponding U.S. Pat. No. 3,714,698 and the corresponding British Pat. No. 1,337,334, there is described a machine and automatic mounting of connection elements adapted to form a plug and socket connection for a separable slide fastener. With this machine, the two stringer halves are separated and the edge at which the box and pin elements are to be applied lie in the plane of the stringer so that the mounting for threading onto the box and pin elements onto the respective edges can also be in this plane.

This system requires a complex mechanism because of the complicated control techniques which are required and may not always be reliable because of tolerance variations which may cause relative shifting of the stringer halves. This can result in defective slide fastener stringers.

OBJECTS OF THE INVENTION

It is the principal object of the present invention to provide an improved method of mounting box and pin connectors on respective stringer halves whereby the disadvantages of earlier systems are obviated.

Another object of this invention is to provide an automatic machine or apparatus for applying box and pin connectors to a stringer which will eliminate the tolerance problems hitherto encountered, which will reliably carry out the mounting operations and which is less expensive to make and operate than earlier connector mounting machines.

SUMMARY OF THE INVENTION

These objects and others which will become apparent hereinafter are attained, in accordance with the present invention, in a method of mounting the pin and box connectors of a separable slide fastener on a stringer where the two stringer halves are coupled together by the interdigitation of the respective coupling heads. According to this invention, a stretch of the stringer band is deflected out of the plane of advance thereof at a mounting angle such that the T-shaped window formed in this band at the location to which the box pin connectors are to be applied, enables each of the connectors to be threaded onto the edge of the respective support tape, the slider having previously been mounted on the stringer.

More specifically, the stringer band is advanced stepwise through the mounting machine and, being preformed with the T-shaped windows and having the slider previously mounted thereon, the stringer band is advanced in a direction parallel to the shank orientation of the T-shaped window. Consequently, the shank of this T-shaped window or cutout extends in the direction of advance of the band through the mounting machine.

At a deflection station within this machine the strip is deflected out of the plane of the stringer at the aforementioned mounting angle so that as the T-shaped opening approaches the vertex of this angle or forms the vertex, the edges of the shank in the stringer plane enable the box and pin elements to be threaded onto these edges and thereafter clamped therearound.

The box and pin connectors are fed in the shadow of the deflected stretch of the band, i.e. in the plane from which this stretch of the band has been deflected and directly below this band if the deflection is upward, directly above this stretch if the deflection is downward or, where the deflection is effected out of a vertical plane, at one side or the other side of the deflected stretch so that the feed of the connecting elements is effected in the projection of the deflected stretch onto an extension of the stringer plane in the direction of feed of the stringer.

It has been found to be advantageous to utilize a pin element which is a split sleeve threaded over the edge of the tape and coupled thereon.

When this split sleeve cannot be guided into the box element except in the coupled state of this split sleeve, we have found it to be advantageous to thread the split sleeve first onto its shank edge and clamp it thereto and thereafter at the same location of the mounting machine and in the same position of the stringer, to apply the box element over the pin and its edge of the tape and to clamp the box element in place. The invention can make use of a multipart-box element which can include a box sleeve which can be threaded onto the edge of its side of the shank and clamped therearound, and a casing which is clamped to the latter sleeve and is passed thereover before being so clamped.

The advantages of this method derive largely from the fact that the two stringer halves are handled in a clamped state and are provided with the pin and box elements in this state so that realignment of the stringer halves is not a problem.

The apparatus, of course, will include a guide and feed device for displacing the stringer strip or band through the machine with the stringer halves coupled together and having the sliders mounted thereon. The deflection station comprises at least one deflection element, e.g. a deflection roller and a holding tool having upper and lower tool parts engageable with the stringers from the upper and lower sides thereof, at least the upper part having an opening permitting the passage of a stamping plunger or ram. The lower tool part can thus define an anvil. A clamping device is formed by the ram and the apparatus is equipped with a pin feeder and a box feeder adapted to feed the respective connecting elements in the plane of the slide fastener upstream of the deflected portion and, of course, magazines or charging units for supplying the connection elements to the respective feeders.

According to an important aspect of the invention, the deflection element, e.g. the roller, can be lifted when the band is engaged by the upper or lower holding members of the tool to precisely position the T-shaped window for mounting the respective elements upon the stringer halves.

The tool can include means cooperating with the respective feeders for guiding the connecting elements onto the tape and means for fixing the stringer in position with respect to the mounting station. An actuator or switching device can be provided for controlling the apparatus which includes a switching finger engageable in the T-shaped opening while the band advancing unit can include a switching elements which establishes the tension thereof.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 14:
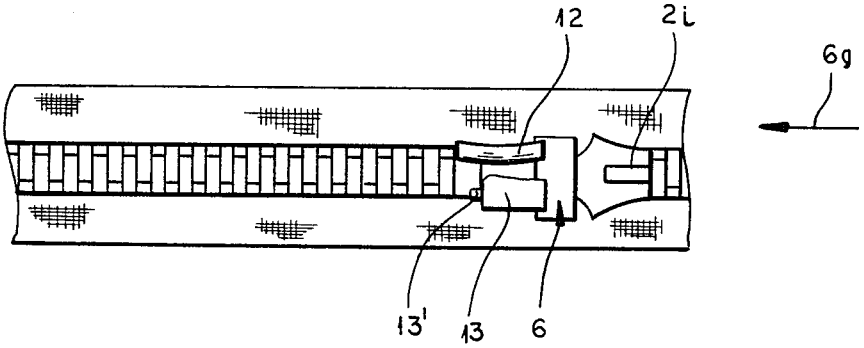
FIG. 14 is a view similar to FIG. 13 and partly broken away showing the pin and box elements in place.

Referring first to FIG. 14, it will be understood that the invention is applicable to a stringer band 2 which can be used to form a plurality of stringers of which portions of two such stringers are shown at **2*a* and 2*b*. The stringer band can thus be subdivided along the dot-dash line 2*c*** to form the respective stringers.

Each of the stringers comprises a stringer half **2*d*, 2*e*, whose coupling elements 2*f* and 2*g*** form heads which interdigitate with one another.

The stringers which are formed can be of the separable type, i.e. while they are connected together by respective sliders **2*h*, the free ends upon severing along the line 2*c* can spread apart when the slider is moved to the right. The slider 2*h* has a tab 2*i*** which is pivotally mounted thereon to facilitate manipulation.

Prior to reaching the mounting zone of the machine, the band 2 is punched to form windows but which are of transconfiguration and have shanks **6*a* extending in the feed direction 6*b*' of the stringer band. A cross bar 6*b* of each window defines transverse edges 6*c* and 6*d* while the longitudinal edges 6*e* and 6*f*** are formed by the tapes supporting the coupling elements of the respective stringer halves.

The pin connector 12 is a split sleeve which is threaded onto the edge **6*e* passing over the edge 6*c* being mounted in the direction of arrow 6*g*. The box connector 13 can be applied over a similar split sleeve 13' which is mounted on the edge 6 and after being threaded past the edge 6*d*. The connectors are clamped onto the respective edge. The pin 12 is dimensioned and shaped so that it can be inserted through a slider at the right-hand end of the stringer 26 and then into the box 13** to align the ends of the stringer and enable the coupling elements to be interdigitated upon movement of the slider to the right.

Other FIGURES of the drawing, in highly diagrammatic form, represent a mounting machine for carrying out the method of the invention.

Figure 1:
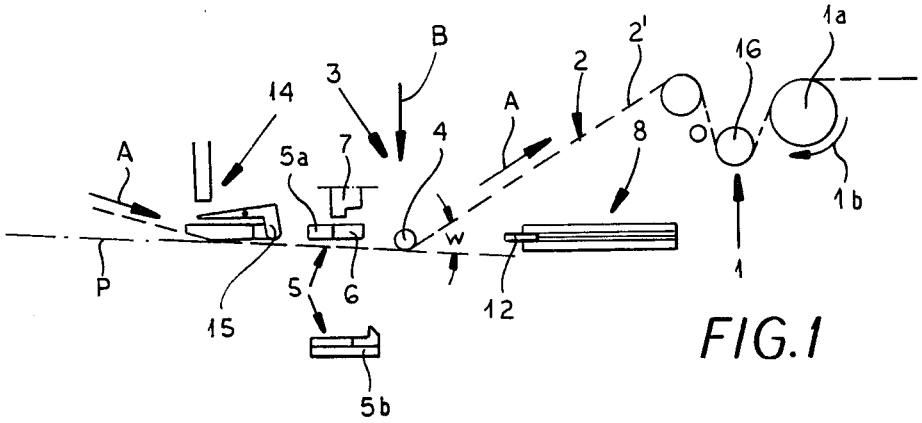
FIG. 1 is a side-elevational view diagrammtically illustrating a mounting machine embodying the invention.
Figure 13:
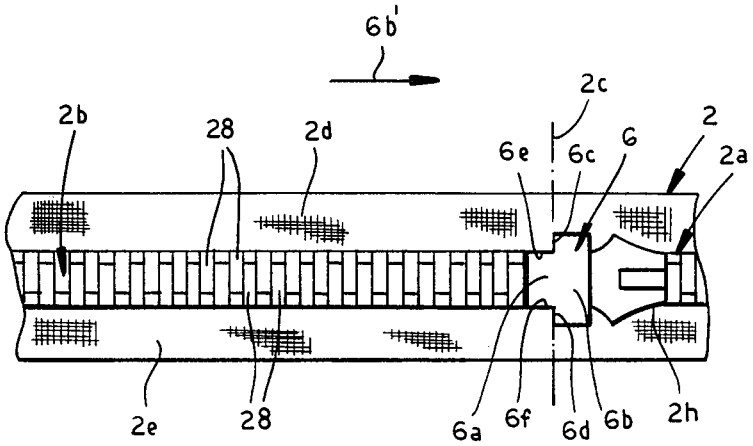
FIG. 13 is a plan view drawn to a larger scale and also in diagrammatic form showing the band prior to the application of the pin and box elements.

This machine comprises a band advancing and guide mechanism represented generally at 1 and comprising a plurality of feed and guide rollers, at least one of which can be driven as shown at **1*a* by the arrow 1*b* to apply a predetermined tension to the band 2 when it is advanced in the direction of arrow A in FIG. 1. The band 2 has the sliders previously mounted therein and is formed with the T-shaped window as described in connection with FIG. 13**.

Figure 3:
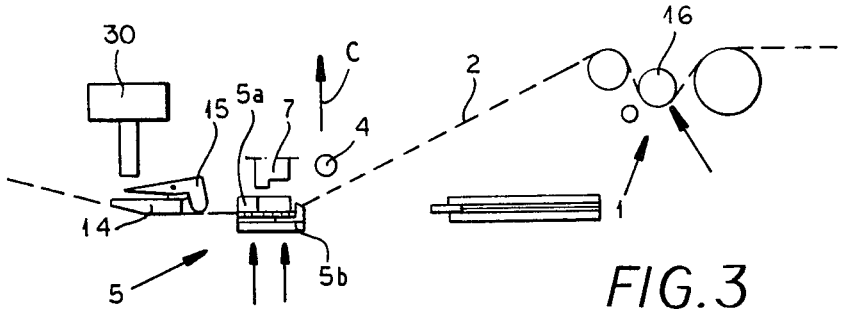

The machine is provided, along the path of the band 4 with a deflection stage 3 having a deflecting element 4 in the form of a roller which can be displaced as represented by the arrows B and C in FIG. 1 and 3, respectively.

Figure 2:
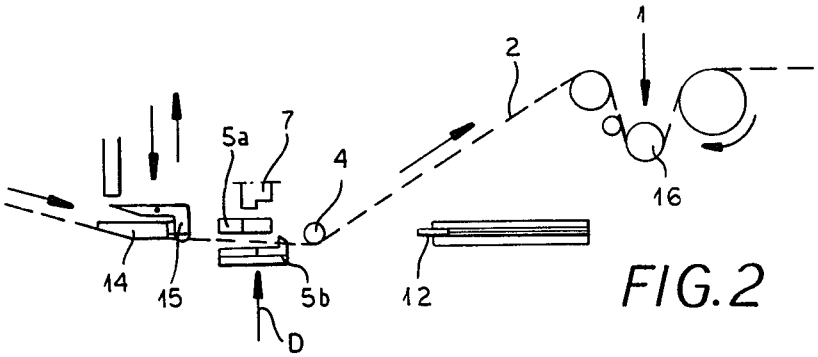
FIGS. 2–6 and 10–12 are diagrams showing the machine in various functional positions.

The stringer plane is represented at P in FIG. 1 and a stretch 2' of the band 2 is deflected out of the plane to define a mounting angle W. Upstream of the deflection element 4, a band holding tool 5 is provided, this tool having upper and lower members which are relatively displaceable as represented by the arrow D in FIG. 2. In this embodiment, the upper member **5*a* may be stationary although it also may be movable in the vertical direction. A coupling plunger that is vertically displaceable as represented by the arrow E and can pass through an opening 6 in the upper tool member 5***a*.

The basic elements of the apparatus also comprise a pin feeder 8 displaceable in the direction of arrow F and in the opposite direction (see FIG. 4) for threading the split sleeve pin 12 onto the edge of the tape, and a box applier 9 for mounting the box 13 onto the tape, the box applier 9 being coplanar with the pin applier 8 and being displaceable in the direction of arrow F as well.

The arrows A–F and those yet to be described not only represent the direction of displacements of the movable parts, but also means, to the extent not further illustrated, for displacing these elements in the direction represented by the arrows.

The pin applier 8 is associated with a pin feeder 10 shiftable in the direction of the arrow G while the box applier 9 cooperates with a box feeder 11 delivering the boxes in the direction of the arrow H. Both feeders may be displaceable in the direction of the arrow I for mounting the pin and box on the respective appliers. The feeders can, of course, be provided with respective machines delivering the pins and box in appropriate orientations and in succession to the feeders and enabling the pins and boxes to be picked up by the respective appliers 8 and 9.

The appliers are positioned to pass the pin and the box for each stringer through the bar portion of the respective window 6 and onto the respective edge 6*e* and 6*f* in the manner described. Once the pin and box are in place, they can each be clamped against the tape of the plunger 7 and the latter can clamp the pin first and then urging the box in successive operations.

Upstream of the holding tool 5 in the transverse direction, a switching device 14 is provided which has a finger adapted to engage in the T-shaped opening 6 when the latter approaches the tool to trigger a control circuit represented at 30 to actuate the other displaceable members in the sequence which enables the pin and box connectors to be applied and clamped in the manner described. The band advance mechanism 1 is provided with a switching element 16 controlling the tension on the band, e.g. by regulating a motor driving member 1*a* previously described.

Figure 7:
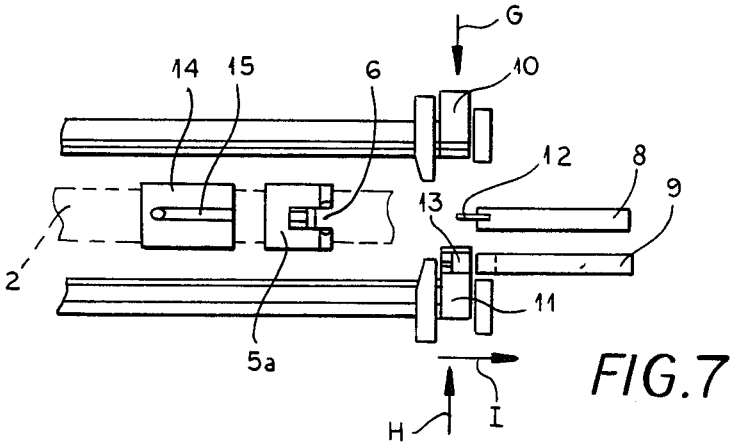
FIG. 7 is a plan view of the machine shown in FIG. 1 also in highly diagrammatic form.

When the window detector 15 detects the window, the tool 5 is raised (FIG. 2) and the band is ultimately clamped (FIG. 3), the deflector 4 having previously been lifted so that the window appears at the right-hand end of the tool 5 in proper position for application of the pin and box as can be seen from FIG. 7. The appliers 8 and 9 are displaceable transversely as represented by the arrow I to align first one and then the other with the respective edge and to allow pickup of the box or pin.

In spite of the fact that the flanges 15 may have dropped into the window (FIG. 2), the advance mechanism 1 continues to drive forwardly to increase the tension of the band until the desired tension detected by member 16 is reached and further drive is terminated (FIG. 3).

The switching element 16 can be a roller which is lifted by the increased tension and whose elevation operates a switch.

Figure 4:
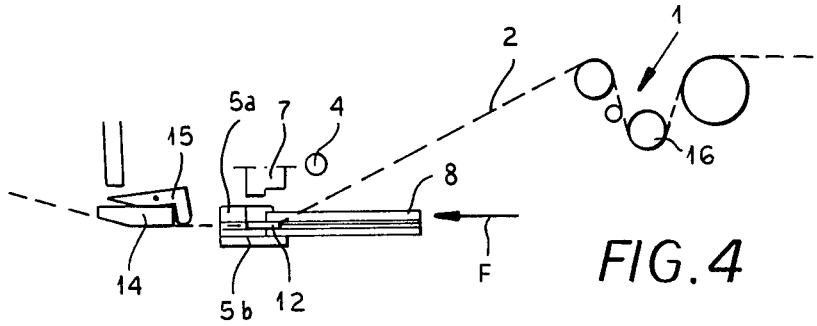
Figure 5:
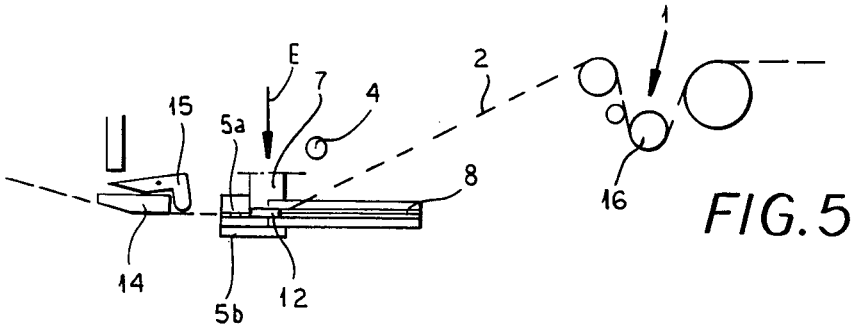
Figure 6:
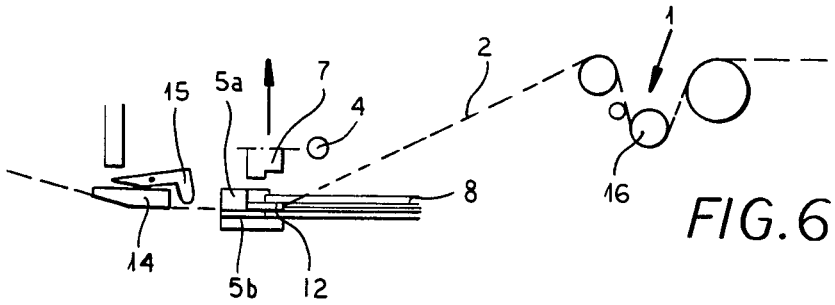
Figure 8:
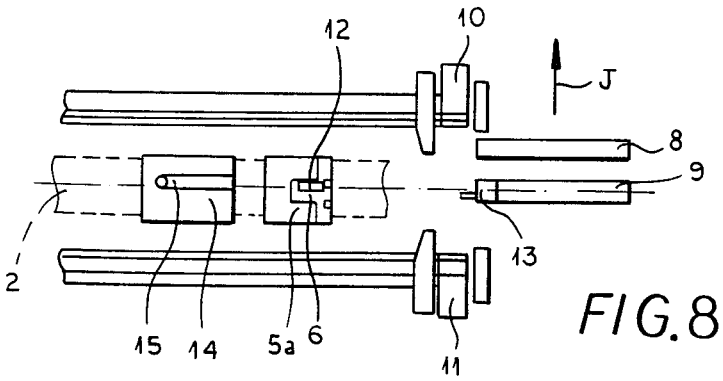
FIGS. 8 and 9 are plan views showing other operating positions of the parts of the machine.
Figure 9:
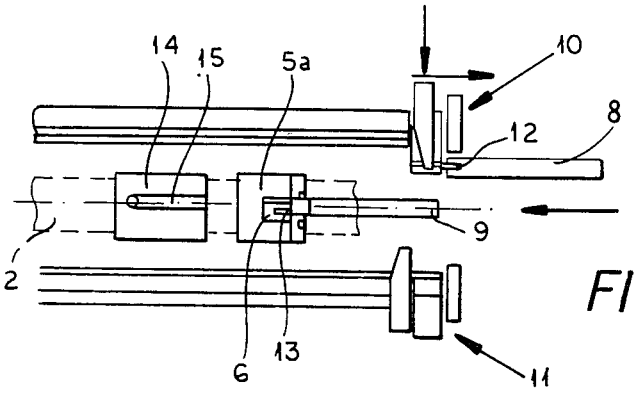
Figure 10:
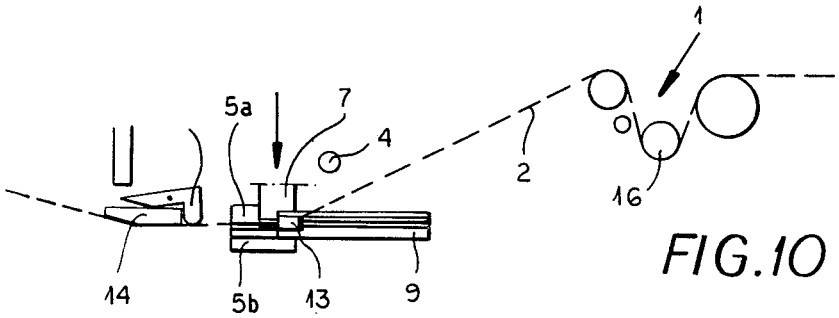
Figure 11:
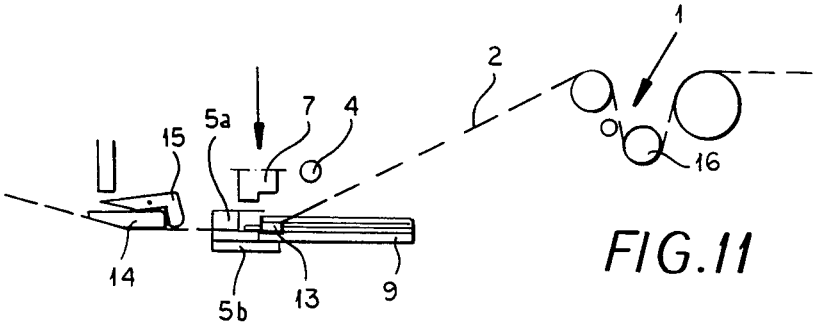
Figure 12:
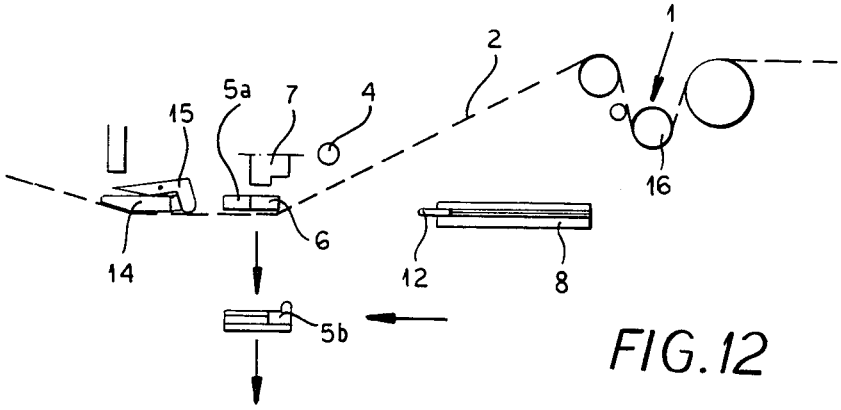

From FIG. 4 the application of the pin 12 will be apparent and the pin is then clamped by actuation of the plunger 7 as represented in FIG. 5. The box 9 can then be mounted (FIGS. 8 and 9) and clamped in place as shown in FIG. 10. The tool is then opened (FIG. 12) and the roller 4 lowered, and the stringer band then advanced (FIG. 1). It will be apparent that the box 13 is not only applied over the pin 12 but is clamped onto its edge of its stringer half.

We claim:

1. A method of mounting box and pin connection elements on an end of a stringer for a separable slide fastener which comprises the steps of:

(a) advancing a stringer band comprising a pair of stringer halves having interdigitating coupling elements and provided with sliders for each of a succession of stringers and T-shaped windows in a direction of advance of said band along a stringer plane so that a shank portion of each window extends in said direction and edges of said shank portion are formed on respective stringer-half tapes;

(b) deflecting said band at a mounting station along a path of the band so that a stretch ahead of each window is inclined at a mounting angle at said plane and said edges are exposed through the window and in a shadow of said stretch; and (c) inserting through each window in said shadow of said stretch a pin element onto one of said edges and a box element onto the other of said edges and coupling said element onto the respective edges.

2. The method defined in claim 1 wherein said pin element can only be received in said box element in a clamped condition of said pin element, said method comprising first applying said pin element to its respective edge and then clamping said pin element to its respective edge before applying said box element over said pin element and the edge at which said box element is to be clamped.

3. The method defined in claim 1 wherein said elements are applied together to the respective edges and clamped thereto in at least one step.

4. The method defined in claim 3 wherein said elements are clamped to the respective edges in successive steps.

5. The method defined in claim 1 wherein said elements are applied in succession to the respective edges and clamped thereto in at least one step.

6. The method defined in claim 5 wherein said elements are clamped to the respective edges in successive steps.

7. An apparatus for mounting connection elements for a separable slide fastener on a stringer band comprising interconnected stringer halves having respective sliders mounted thereon, said stringer band being provided with T-shaped windows defining edges adapted to receive a pin element and a box element, respectively, said apparatus comprising:

band advancing and tensioning means for advancing said band along a path and applying tension to said band along said path;

a holding tool having members disposed on opposite sides of said band at a station along said path for engaging said band between them;

a movable deflector disposed downstream of said tool at said station for deflecting a stretch of said band from a stringer plane at a mounting angle, said deflector being shiftable to form a vertex of said angle at said tool whereby said edges are exposed through the respective window;

means for mounting a pin element on a respective one of said edges and for mounting a box element on the other of said edges in the shadow of said stretch; and a coupling plunger displaceable transversely to said plane through an opening formed in one of said members of said tool for coupling said elements onto the respective edge.

8. The apparatus defined in claim 7 wherein said means for mounting said pin elements include a pin applier shiftable through said opening in said plane.

9. The apparatus defined in claim 8 wherein said means for mounting said box elements include a box applier for shifting a box element through said window in said plane.

10. The apparatus defined in claim 9, further comprising means for feeding said pin elements and box elements respectively to said pin applier and said box applier.

11. The apparatus defined in claim 10, further comprising a sensor for said window disposed upstream of said tool with respect to a direction of displacement of said band.

12. The apparatus defined in claim 11 wherein said sensor includes a finger engageable in said window.

13. The apparatus defined in claim 12 wherein said means for advancing said band includes a mechanism for monitoring the tension of said band.

* * * * *